US005281168A

United States Patent [19]

Krehbiel et al.

[11] Patent Number: 5,281,168

[45] Date of Patent: Jan. 25, 1994

[54] ELECTRICAL CONNECTOR WITH TERMINAL POSITION ASSURANCE SYSTEM

[75] Inventors: Fred L. Krehbiel, Chicago; James S. Felbinger, Lombard, both of Ill.

[73] Assignee: Molex Incorporated, Lisle, Ill.

[21] Appl. No.: 979,730

[22] Filed: Nov. 20, 1992

[51] Int. Cl.[5] ..... H01R 13/40

[52] U.S. Cl. ..... 439/595; 439/598; 439/752

[58] Field of Search ..... 439/135, 136, 138, 143, 439/145, 595, 597-599, 752

[56] References Cited

U.S. PATENT DOCUMENTS

| | | | |
|---|---|---|---|
| 4,772,229 | 9/1988 | Nix et al. | 439/733 |
| 4,846,737 | 7/1989 | Jorroch et al. | 439/752 |
| 4,867,712 | 9/1989 | Kato et al. | 439/752 |
| 4,946,399 | 8/1990 | Kawashima | 439/752 |
| 4,971,579 | 11/1990 | Mobley et al. | 439/595 |
| 4,971,580 | 11/1990 | Ward et al. | 439/595 |
| 5,069,639 | 12/1991 | Kodama et al. | 439/752 |
| 5,085,599 | 2/1992 | Maejima et al. | 439/598 |
| 5,122,080 | 6/1992 | Hatagishi et al. | 439/598 |

*Primary Examiner*—P. W. Echols
*Attorney, Agent, or Firm*—A. A. Tirva

[57] ABSTRACT

An electrical connector assembly includes a terminal position assurance system. The assembly includes an elongated dielectric housing having a plurality of terminal-receiving cavities extending transversely of the housing. A plurality of terminals are insertable into the cavities. A passageway extends longitudinally of the housing. An elongated terminal position assurance member is insertable into the passageway and movable between a preloaded position and a loaded position. The terminal position assurance member prevents mating of a complementary connector with the connector assembly when the member is in its preloaded position. A plurality of primary locking devices are provided on the housing and movable between locking positions to lock the terminals in their respective cavities when the terminals are fully loaded into the cavities and second positions projecting into the passageway when the terminals are only partially loaded into their respective cavities to thereby prevent the terminal position assurance member from moving from its preloaded to its loaded position. Secondary locking devices are operatively associated between the terminal position assurance member and the primary locking devices to hold the primary locking devices in their first locking positions when the terminal assurance member is in its preloaded and loaded positions.

6 Claims, 5 Drawing Sheets

ELECTRICAL CONNECTOR WITH TERMINAL POSITION ASSURANCE SYSTEM

FIELD OF THE INVENTION

This invention generally relates to the art of electrical connectors and, particularly, to an electrical connector assembly which includes a terminal position assurance system whereby the connector assembly cannot mate with a complementary mating connector assembly unless all of the terminals are properly positioned.

BACKGROUND OF THE INVENTION

A common type of electrical connector includes a dielectric housing having a plurality of terminal-receiving cavities within which are mounted a plurality of terminals. The terminals may be stamped and formed metal components and include a mating end for mating with terminals of a complementary electrical connector assembly, along with terminating ends for termination to a plurality of electrical cables, wires or to circuitry on a printed circuit board, for instance. The terminals must be properly positioned within their respective housing cavities for proper mating with the terminals of the complementary connector assembly.

Improper installation of electrical connectors has long been a problem in mating connector assemblies having large numbers of terminals for interconnecting large numbers of electrical circuits. The mating assemblies may perform quite adequately under normal circumstances, but open circuits can occur when the terminals are not properly positioned within the dielectric housings of the connector assemblies or when the assemblies are not properly mated. In addition to open circuits, terminal retention also is important because of problems that can be encountered due to continuous mating and unmating of the connectors over the life of the assemblies. In addition, use of the connectors in vibration environments can cause the terminals to become loosened and improperly positioned. Improper retention of the terminals can result in unstable electrical interconnections.

Various designs have been used to improve the retention of terminals within electrical connector housings and to improve the mating integrity of the connector assemblies themselves. For example, regarding the mating connectors, plastic terminal latches integral with the connector housings often are used to enhance the mating integrity between the connectors. However, regardless of the integrity between the connector housings themselves, if the terminals are improperly positioned, open circuits, terminal damage and other problems can occur even though the connector housings are properly mated. Therefore, various devices have been designed to protect against improperly positioned terminals and, in fact, to prevent the connector assemblies from mating unless all of the terminals therewithin are properly positioned. Such devices commonly have been called "terminal position assurance" devices.

For instance, a known terminal position assurance system in an elongated connector utilizes an elongated terminal position assurance (TPA) member extendable longitudinally through the housing, with the TPA member including a plurality of primary locking devices for retaining the terminals within the connector. Secondary locks on the TPA member are effective to prevent unlocking of the primary locking devices. The connector cannot mate with a complementary connector unless the TPA member is properly positioned. Although this system is quite effective, by providing both the primary locking devices and the secondary locks on the TPA member itself, the system is somewhat complicated and, in some applications, may not be totally cost effective. This invention is directed to an improved system of the character described wherein the primary locking devices are located on the connector housing and the secondary locking devices are located on the TPA member. This system simplifies the TPA member design and provides for more cost effective manufacture of the TPA member and the connector housing.

SUMMARY OF THE INVENTION

An object, therefore, of the invention is to provide a new and improved terminal position assurance system for an electrical connector assembly.

In the exemplary embodiment of the invention, the connector assembly includes an elongated dielectric housing having a plurality of terminal-receiving cavities extending transversely of the housing. A plurality of terminals are insertable transversely of the housing into the cavities. A passageway extends longitudinally of the housing, and an elongated terminal position assurance (TPA) member is insertable into the passageway. The TPA member is movable between a preloaded position and a loaded position. The TPA member prevents mating of the connector assembly with a complementary connector assembly when the TPA member is in its preloaded position.

The invention contemplates the provision of a plurality of primary locking devices on the connector housing and movable between locking positions to lock the terminals in their respective cavities when the terminals are properly positioned or fully loaded into the cavities, and second positions projecting into the passageway when the terminals are only partially loaded into their respective cavities. If any one of the primary locking devices is in its second position, the TPA member is prevented from moving from its preloaded position to its loaded position which, in turn, prevents mating of the connector assemblies. A secondary locking means is provided on the TPA member and is provided on the TPA member and is operatively associated between the primary locking devices to hold the primary locking devices in their first, locking positions when the TPA member is in its loaded position.

In the preferred embodiment of the invention, the dielectric housing is molded of plastic material, and the primary locking devices are provided by resilient cantilevered latch arms. The TPA member includes a plurality of ribs separated by grooves spaced lengthwise of the member. When the TPA member is in its preloaded position, the bottoms of the grooves, between the ribs, define wall means located to prevent overstressing of the resilient cantilevered latch arms. When the TPA member is in its loaded position, allowing mating of the connector assemblies, the ribs of the TPA member are located for blocking movement of the cantilevered latch arms from their locking positions to their second positions and thereby retain the terminals within the housing. If any terminal is not fully loaded, its respective cantilevered latch arm projects into the passageway of the TPA member; the TPA member therefore cannot move to its loaded position; and the mating connectors consequently cannot be mated.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figures 1, 2:
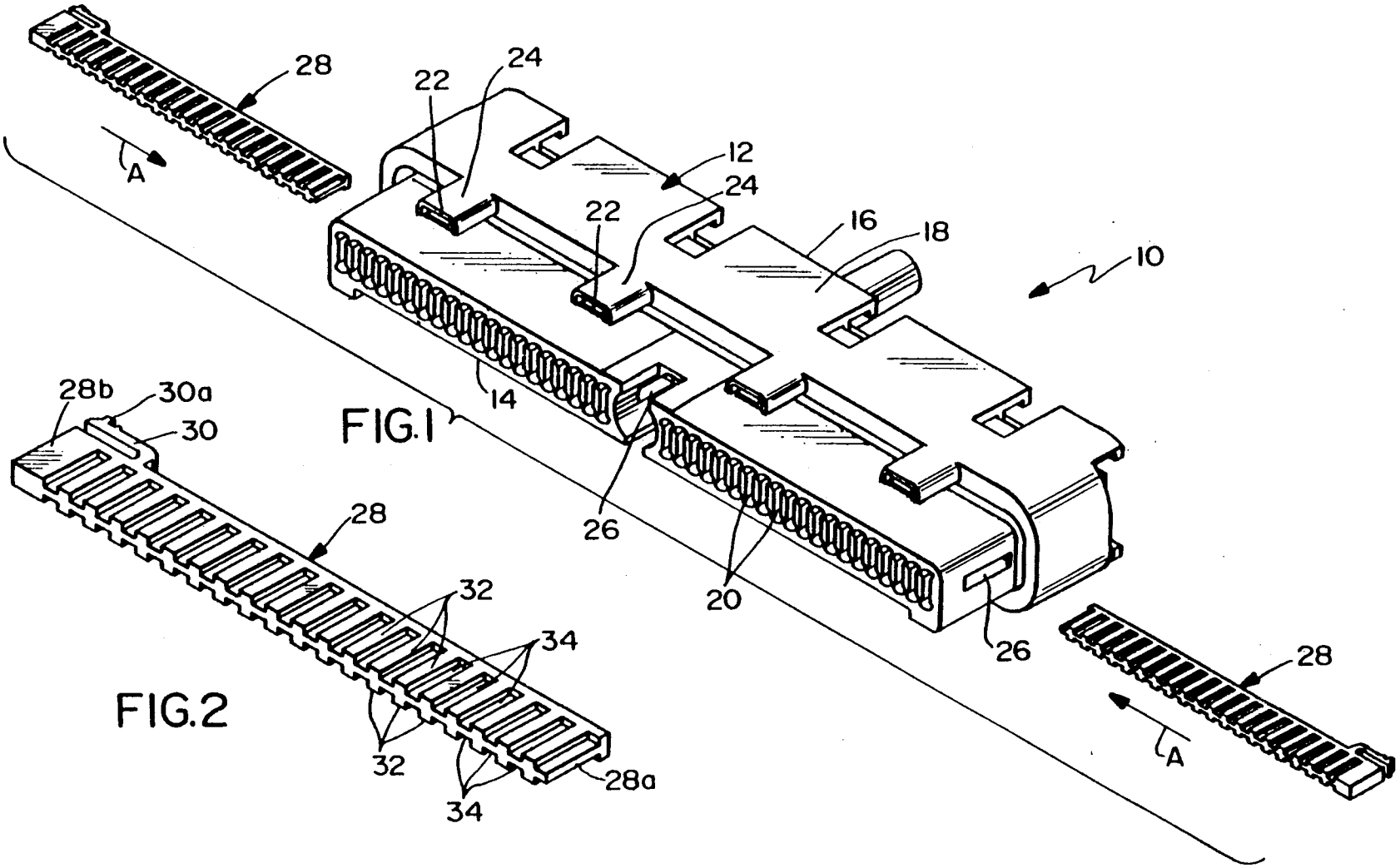
FIG. 1 is an exploded perspective view of an electrical connector assembly embodying the concepts of the invention, and including a pair of TPA members.
FIG. 2 is a perspective view on an enlarged scale, of one of the TPA members.

Referring to the drawings in greater detail, and first to FIG. 1, an elongated electrical connector assembly, generally designated 10, is shown to include a dielectric housing, generally designated 12, which includes a mating end 14 and a terminal/wire receiving or terminating end 16 defined by a rear housing portion 18. The housing includes a plurality of terminal-receiving cavities 38 communicating between the mating and terminal-receiving ends of the housing. A plurality of cantilevered spring latch arms 22 are protected within respective hoods 24 for latching the connector assembly to a complementary mating connector (not shown). A passageway 26 extends longitudinally through the housing for receiving a pair of terminal position assurance (TPA) members, generally designated 28. The TPA members are insertable into open ends of passageway 26 at opposite ends of the connector housing, in the direction of arrows "A".

Although two TPA members 28 are shown in FIG. 1 for insertion into opposite ends of passageway 26 of connector 10, it should be understood that a single TPA member could be employed and inserted into the passageway the entire length of the connector assembly. A pair of TPA members are shown and utilized in the preferred embodiment for manufacturing and assembly convenience and efficiency.

FIG. 2 shows one of the TPA members 28 to be an elongated strip having a distal insertion end **28*a* and a proximal gripping end 28*b* adjacent which is located a cantilevered latch arm 30. The latch arm has a latch hook 30*a* for latching the TPA member in its preloaded and fully loaded positions, as will be described hereinafter. The TPA member is unitarily molded of dielectric material, such as plastic or the like, and each longitudinal side of the member is formed with a plurality of ribs 32 spaced longitudinally of the member and separated by a plurality of grooves 34**.

Figure 3:
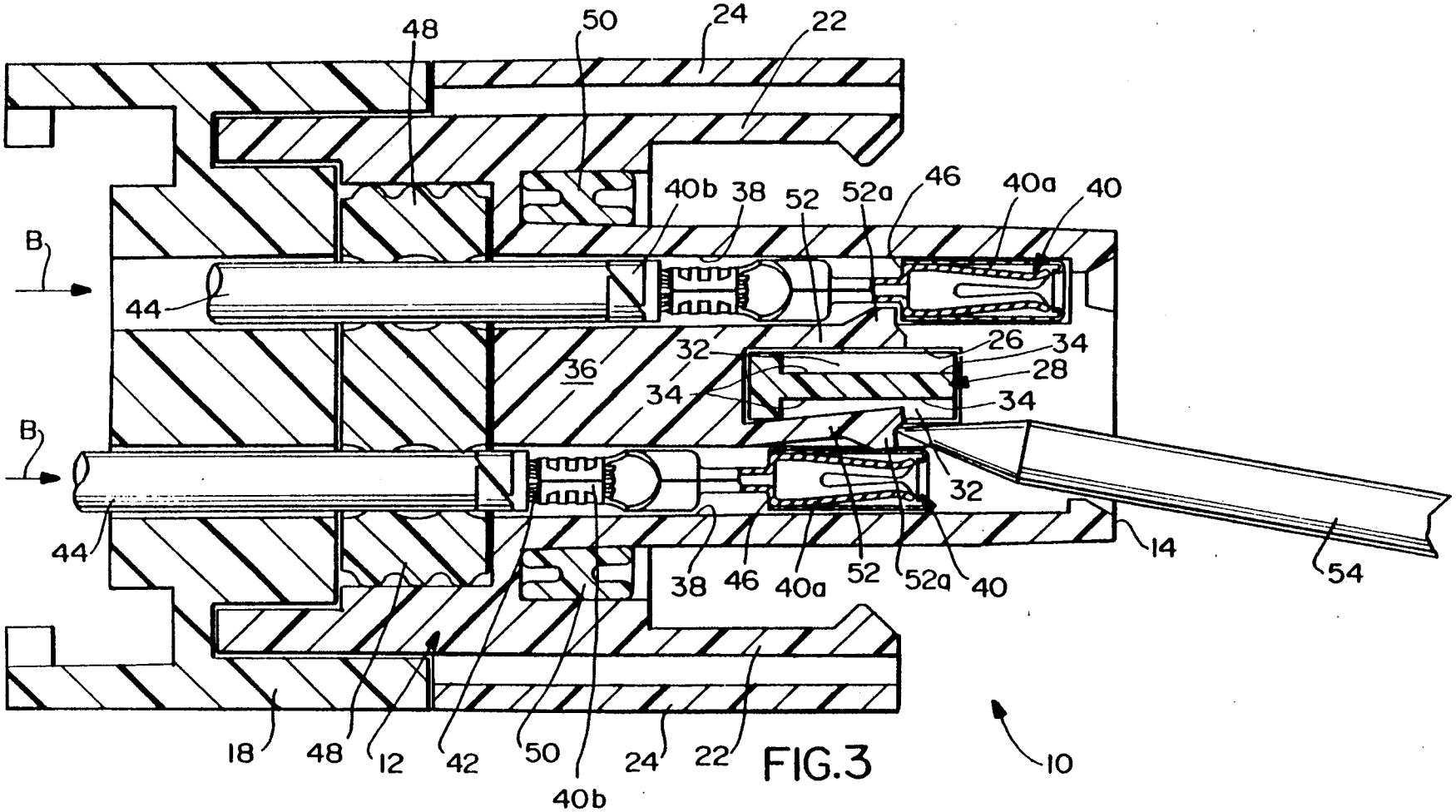
FIG. 3 is a cross-sectional view through the connector assembly, with the illustrated left-hand terminal fully loaded within the connector housing, with the right-hand terminal not fully loaded within the housing, and with the TPA member in its preloaded position.

Referring to FIG. 3, each terminal-receiving cavity 38 in housing 12 is separated by a central partition 36 to define a pair of transversely aligned terminal-receiving cavity portions 38. A metal stamped and formed terminal, generally designated 40, is mounted in each cavity portion 38. Each terminal includes a contact receiving end **40*a* and a wire terminating end 40*b*. The contact receiving end is shown to be of a "female" configuration for receiving a male terminal or contact pin of a complementary mating connector (not shown). Wire terminating end 40*b* is provided for termination to conductors 42 of an insulated electrical wire 44. Each terminal 40 is provided with an inwardly facing locking shoulder 46. Terminals 40 and terminated wires 44 are inserted into cavity portions 38 in housing 12 in the direction of arrows "B". A seal 48 is provided inside rear housing portion 18, and seals 50** are provided for sealing with portions of the complementary mating connector.

Still referring to FIG. 3, generally, the invention contemplates a plurality of primary locking devices on housing 12 and movable between locking positions to lock terminals 40 in their respective cavities or cavity portions when the terminals are fully loaded into the cavities, and second positions projecting into passageway 26 for TPA member 28. More particularly, housing 12 is molded of dielectric material such as plastic or the like, and the primary locking devices are provided by resilient cantilevered latch arms 52 having hook portions **52*a* for locking under shoulders 46 of the respective terminals. In FIG. 3, the left-hand terminal 40 is shown in its fully inserted and properly positioned condition. It can be seen that hook portion 52*a* of the left-hand cantilevered latch arm 52 is in a locking position behind shoulder 46 of the left-hand terminal to lock the terminal in its fully loaded position. It also is important to note that the left-hand cantilevered latch arm 52 does not project into passageway 26 for TPA member 28**.

Now, referring to the right-hand terminal 40 in FIG. 3, it can be seen that this terminal is not fully loaded nor properly positioned within the connector housing. In this position, it can be seen that hook portion **52*a* of the right-hand cantilevered latch arm 52 abuts against the side of the terminal, and the right-hand cantilevered latch arm projects into passageway 26 for TPA member 28. Right-hand terminal 40 in FIG. 3 is shown in a partially loaded position for two purposes. First, this position can represent an improperly positioned terminal. Second, it also shows how a tool 54 can be inserted into cavity 20 to move the cantilevered latch arms 52 inwardly and allow selective removal of the terminal and its respective electrical wire 44**.

Still referring to FIG. 3, generally, TPA member has a preloaded position and a loaded position longitudinally of the connector housing, with the preloaded position being shown in FIG. 3, and the loaded position being shown in FIG. 4 as described hereinafter. In its preloaded position of FIG. 3, it can be seen that grooves 34, spaced lengthwise of the TPA member, are aligned with the primary locking devices defined by cantilevered latch arms 52. Therefore, the latch arms are allowed to flex inwardly into the grooves to allow loading and unloading of terminals 40. When all of the terminals are fully loaded or properly positioned within the connector housing, the cantilevered latch arms flex outwardly to their locking positions as shown by the left-hand latch arm 52 in FIG. 3. In their locking positions, the latch arms 52 lock the terminals in their fully loaded, proper positions and, in addition, the latch arms are clear of passageway 26 to allow movement of TPA member 28. The bottoms of grooves 34 provide a further function of preventing overstressing of the flexible latch arms away from their locking positions, such as when utilizing tool 54 to remove a terminal.

Figure 4:
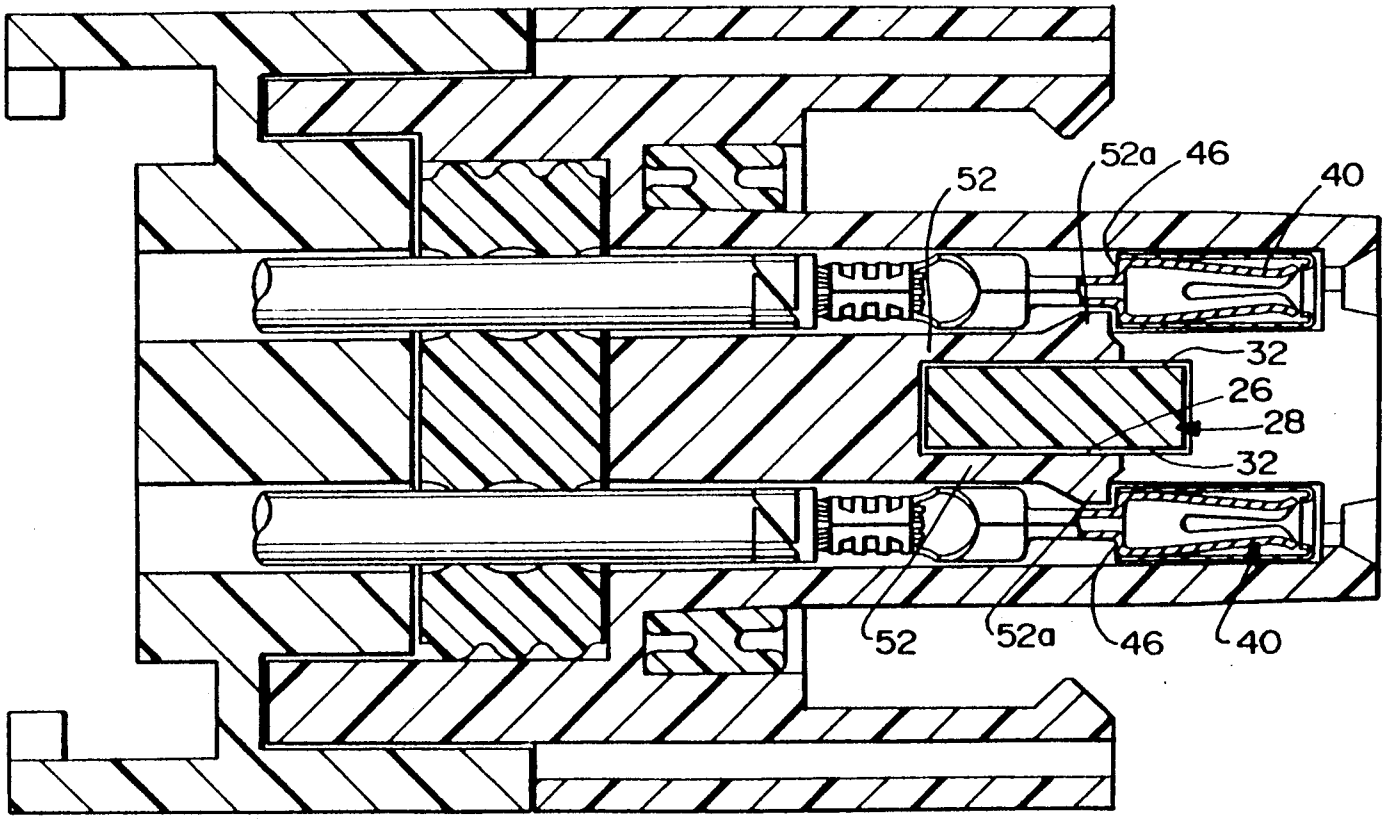
FIG. 4 is a view similar to that of FIG. 3, with both terminal in their fully loaded positions, and with the TPA member in its loaded position.

Turning to FIG. 4, it can be seen that both terminals 40 are fully inserted into the connector housing and, thereby, are properly positioned. It also can be seen that hook portions 52*a* of both primary locking devices or cantilevered latch arms 52 are in their locking positions to lock the terminals in their fully loaded, proper positions. In such a position, TPA member 28 can be moved a small amount (see arrows "A", FIG. 1) to move ribs 32 (FIG. 2) into alignment with cantilevered latch arms 52 as shown clearly in FIG. 4. The TPA member, through ribs 32, thereby provides a secondary locking means operatively associated between the primary locking devices on latch arms 52, to hold the latch arms in their locking positions behind shoulders 46 of terminals 40. It should be understood that if any single terminal 40 is not properly positioned or fully loaded within the connector, TPA member 28 cannot be moved to its loaded position as shown in FIG. 4. In other words, the cantilevered latch arm 52 for that single terminal will remain in its position shown by the right-hand latch arm in FIG. 3 and, thereby, block any movement of the TPA member to its loaded position.

Figure 5C:
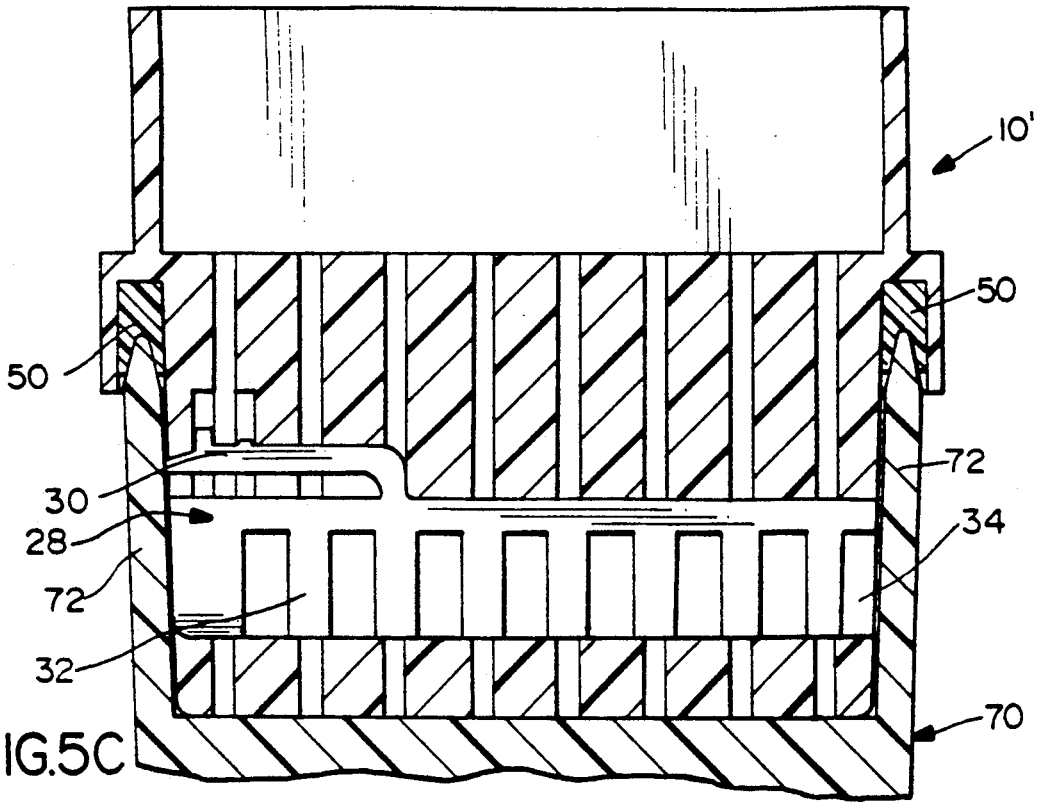
FIG. 5C is a view similar to that of FIGS. 5A and 5B, with the connector assemblies in fully mated condition.
Figure 5B:
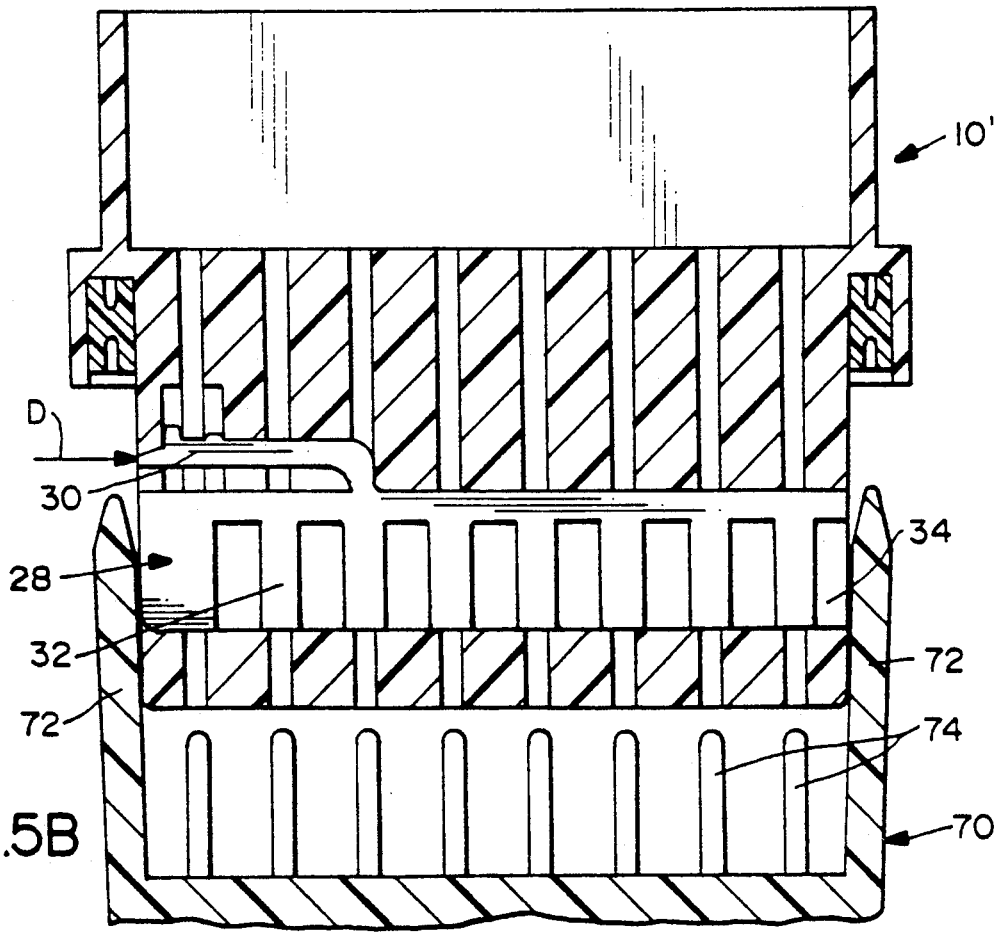
FIG. 5B is a view similar to that of FIG. 5A, but showing the TPA member in its loaded position allowing mating of the connector assemblies.
Figure 5A:
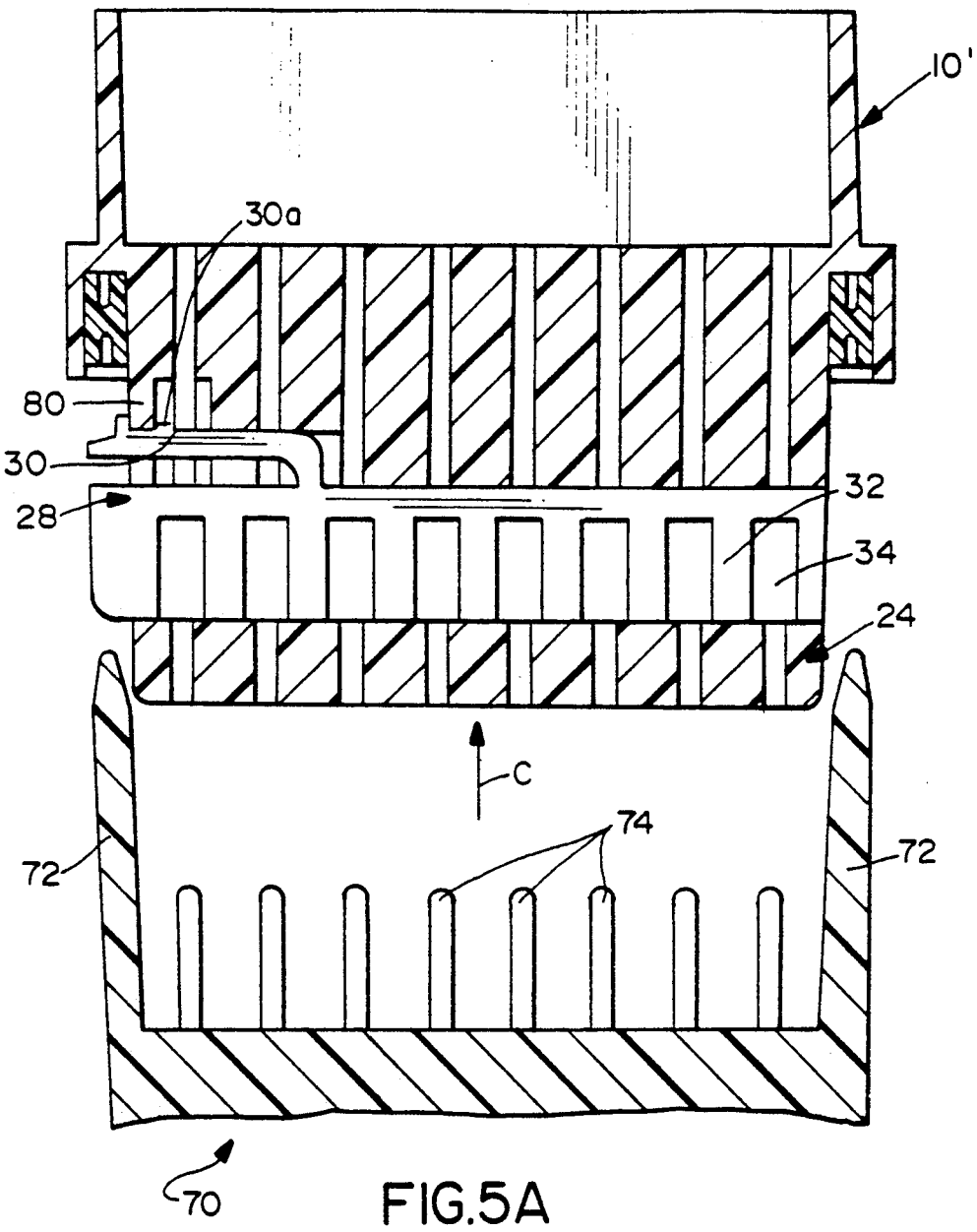
FIG. 5A is a longitudinal section through a connector assembly, with the TPA member in its preloaded position and illustrating how the TPA member prevents mating of the connector assembly with a complementary connector.

FIGS. 5A–5C show the invention incorporated in a shorter electrical connector assembly, generally designated 10', and which incorporates only one TPA member 28. Otherwise, like numerals have been applied to FIGS. 5A–5C corresponding to like elements described above in relation to connector assembly 10 in FIGS. 1–4. The simpler connector assembly 10' is shown in FIGS. 5A–5C to illustrate how the TPA member prevents mating of the connector assembly with a complementary connector if the TPA member cannot be moved to its loaded position, i.e. should any terminal not be in its proper, fully loaded position, as described above.

More particularly, FIG. 5A shows TPA member 28 in its preloaded position, with proximal gripping end 28*b* thereof projecting outwardly of one end of the connector assembly. Latch arm 30 of the TPA member also is shown projecting from the end of the connector housing. A complementary mating connector, generally designated 70, also is shown to include end walls 72 which are positionable over housing 12 of connector assembly 10', connector 70 including pin-type terminals 74 for mating with female contact receiving ends 40*a* of terminals 40. With the depiction of FIG. 5A, it can be understood that if an attempt is made to mate connector 70 with connector assembly 10' in the direction of arrow "C", the left-hand end wall 72 of connector 70 will abut the protruding TPA member as long as the TPA member is in its preloaded position, as shown. In other words, if there is even one terminal 40 which is not properly positioned with connector assembly 10', as described above, the TPA member cannot be moved to its loaded position and, therefore, complementary connector 70 cannot be mated with connector assembly 10'.

Now, referring to FIG. 5B, it can be seen that TPA member 28 has been moved inwardly in the direction of arrow "D", whereby end 28*a* of the TPA member now is clear of the path of movement of end wall 72 of complementary mating connector 70. Of course, the position of TPA member 28 in FIG. 5B indicates that all of the terminals have been properly positioned within connector 10' and the primary locking devices afforded by cantilevered latch arms 52 all have been moved to their locking positions as shown in FIG. 4. Latch arm 30 is shown with its latch hook 30*a* latched behind a latching rib 80 of housing 12 to hold the TPA member in its loaded position.

Lastly, FIG. 5C shows complementary mating connector 70 moved to its fully mated condition with connector assembly 10', and with the edges of end walls 72 of connector 70 in engagement with seals 50. Of course, fully mating of connectors 70 and 10' has been allowed because TPA member 28 has been moved to its loaded position and all of the terminals are properly positioned within connector assembly 10'.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a terminal position assurance system, the assembly including an elongated dielectric housing having a plurality of terminal-receiving cavities extending transversely of the housing, a plurality of terminals insertable transversely of the housing into the cavities, a passageway extending longitudinally of the housing, and an elongated terminal position assurance member insertable into the passageway and movable between a preloaded position and a loaded position, the terminal position assurance member preventing mating of the connector assembly with a complementary electrical connector when the terminal position assurance member is in its preloaded position, wherein the improvement comprises a plurality of primary locking devices on the housing and movable between locking positions to lock the terminals in their respective cavities when the terminals are fully loaded into the cavities and second positions projecting into said passageway when the terminals are only partially loaded into their respective cavities to thereby prevent the terminal position assurance member from moving from its preloaded position to its loaded position, and secondary locking means operatively associated between the terminal position assurance member and the primary locking devices to hold the primary locking devices in their first, locking positions when the terminal assurance member is in its loaded position, and wherein said dielectric housing is molded of plastic material, said primary locking devices comprise resilient cantilevered latch arms, and said terminal position assurance member includes wall means located, when the terminal position assurance member is in its preloaded position, to prevent overstressing of the resilient cantilevered latch arms.

2. In an electrical connector assembly as set forth in claim 1, wherein said terminal position assurance member includes a plurality of ribs for blocking movement of the cantilevered latch arms from their locking positions to their second positions when the terminal position assurance member is in its loaded position.

3. In an electrical connector assembly as set forth in claim 2, wherein said terminal position assurance member includes a plurality of grooves between said ribs, the bottoms of the grooves defining said wall means.

4. In an electrical connector assembly as set forth in claim 1, wherein said terminal position assurance member includes a plurality of ribs for blocking movement of the cantilevered latch arms from their locking positions to their second positions when the terminal position assurance member is in its loaded position.

5. In an electrical connector assembly as set forth in claim 1, including latch means operatively associated between said terminal position assurance member and dielectric housing for holding the terminal position member in its preloaded and loaded positions.

6. In an electrical connector assembly as set forth in claim 1, wherein portions of said terminal-receiving cavities are oversized relative to the terminals at an exterior face of the housing to allow insertion of an appropriate tool into the cavities to move the primary locking devices to said second positions and permit withdrawal of the terminals.

* * * * *